US008958721B2

(12) United States Patent
Furukawa

(10) Patent No.: US 8,958,721 B2
(45) Date of Patent: Feb. 17, 2015

(54) IMAGE FORMING APPARATUS

(71) Applicant: Toshio Furukawa, Nagoya (JP)

(72) Inventor: Toshio Furukawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 4 days.

(21) Appl. No.: 13/832,811

(22) Filed: Mar. 15, 2013

(65) Prior Publication Data

US 2014/0003839 A1 Jan. 2, 2014

(30) Foreign Application Priority Data

Jun. 28, 2012 (JP) ..... 2012-145006

(51) Int. Cl.
*G03G 21/16* (2006.01)

(52) U.S. Cl.
CPC ..... *G03G 21/1628* (2013.01); *G03G 21/168* (2013.01)
USPC ..... 399/121; 399/110

(58) Field of Classification Search
USPC ..... 399/121
See application file for complete search history.

(56) References Cited

U.S. PATENT DOCUMENTS

| | | | | |
|---|---|---|---|---|
| 7,937,021 | B2 | 5/2011 | Sezaki et al. | |
| 2004/0101328 | A1 | 5/2004 | Kimura et al. | |
| 2005/0281584 | A1 | 12/2005 | Kimura et al. | |
| 2006/0153589 | A1* | 7/2006 | Sato et al. | 399/110 |
| 2007/0036584 | A1* | 2/2007 | Kimura et al. | 399/116 |
| 2007/0280728 | A1 | 12/2007 | Sezaki et al. | |
| 2010/0247198 | A1 | 9/2010 | Saiki et al. | |
| 2011/0217070 | A1 | 9/2011 | Watanabe | |

FOREIGN PATENT DOCUMENTS

| | | | |
|---|---|---|---|
| JP | 2003-241618 | A | 8/2003 |
| JP | 2004-094151 | A | 3/2004 |
| JP | 2006-139068 | A | 6/2006 |
| JP | 2007-322774 | A | 12/2007 |

(Continued)

OTHER PUBLICATIONS

NPL_Co-pending U.S. Appl. No. 13/626,157, filed Sep. 25, 2012.

(Continued)

*Primary Examiner* — Clayton E LaBalle
*Assistant Examiner* — Jas Sanghera
(74) *Attorney, Agent, or Firm* — Banner & Witcoff, Ltd.

(57) ABSTRACT

Image forming apparatus includes: main body casing having first and second side walls opposite to each other, and upper portion having opening; top cover swingably supported on the upper portion of the main body casing at a position near the second side wall and configured to openably close the opening; endless belt disposed below the top cover and having first end portion closer to the first side wall and second end portion closer to the second side wall; photoconductor drum disposed under the endless belt; development unit disposed under the photoconductor drum and configured to supply developer to the photoconductor drum; and fixing device disposed above the second end portion of the endless belt. The endless belt is configured to be swingable about axis of rotation provided near the second side wall such that the first end portion of the endless belt is swingable in an upper-lower direction.

7 Claims, 6 Drawing Sheets

(56) References Cited

FOREIGN PATENT DOCUMENTS

| | | | |
|---|---|---|---|
| JP | 2008-046403 | A | 2/2008 |
| JP | 2009-211020 | A | 9/2009 |
| JP | 2010-231087 | A | 10/2010 |
| JP | 2011-059182 | A | 3/2011 |
| JP | 2011-180418 | A | 9/2011 |

OTHER PUBLICATIONS

Non-Final Office Action received in corresponding U.S. Appl. No. 13/626,157 mailed May 12, 2014.

* cited by examiner

IMAGE FORMING APPARATUS

CROSS-REFERENCE TO RELATED APPLICATION(S)

This application claims priority from Japanese Patent Application No. 2012-145006 filed on Jun. 28, 2012, the disclosure of which is incorporated herein by reference in its entirety.

TECHNICAL FIELD

The present invention relates to an image forming apparatus with a photoconductor drum disposed under an endless belt.

BACKGROUND ART

There is known an image forming apparatus including a main body casing, a top cover swingably supported on the main body casing, a conveyor belt provided in the top cover and configured to be swingable together with the top cover, and a cartridge disposed under the conveyor belt and including a photoconductor drum for transferring a toner image onto a sheet conveyed by the conveyor belt. The image forming apparatus further includes a fixing device for thermally fixing the toner image on the sheet, at a position opposite to the axis of rotation of the top cover (i.e., at a position near the free end of the top cover), and an ejection roller disposed above the fixing device and configured to eject the sheet outside the main body casing onto a sheet output tray formed on the upper surface of the top cover.

However, in this image forming apparatus, since the ejection roller and the fixing device are provided near the free end of the top cover, these parts will be an obstacle for replacement of the cartridge disposed under the conveyor belt in the case in which the image forming apparatus is installed in such an orientation that the fixing device side faces toward the user (front side) and the user swings the conveyor belt upward together with the top cover. On the contrary, if the image forming apparatus is installed such that the proximal end of the top cover (side on which the axis of rotation of the top cover is located) faces toward the user, the top cover and the conveyor belt will be an obstacle for replacement of the cartridge, when the user rotates the conveyor belt upward together with the conveyor belt.

In view of the above, it would be desirable to provide an image forming apparatus, which can ease the replacement of parts (e.g., photoconductor drum) disposed under an endless belt.

SUMMARY OF THE INVENTION

According to the present invention, an image forming apparatus comprises: a main body casing having a first side wall and a second side wall which are opposite to each other, and an upper portion in which an opening is formed; a top cover swingably supported on the upper portion of the main body casing at a position near the second side wall and configured to openably close the opening; an endless belt disposed below the top cover and having a first end portion closer to the first side wall and a second end portion closer to the second side wall; a photoconductor drum disposed under the endless belt; a development unit disposed under the photoconductor drum and configured to supply developer to the photoconductor drum; and a fixing device disposed above the second end portion of the endless belt. In this image forming apparatus, the endless belt is configured to be swingable about an axis of rotation provided near the second side wall such that the first end portion of the endless belt is swingable in an upper-lower direction.

BRIEF DESCRIPTION OF THE DRAWINGS

To better understand the claimed invention, and to show how the same may be carried into effect, reference will now be made, by way of example only, to the accompanying drawings, in which:

DESCRIPTION OF EMBODIMENTS

Figure 1:
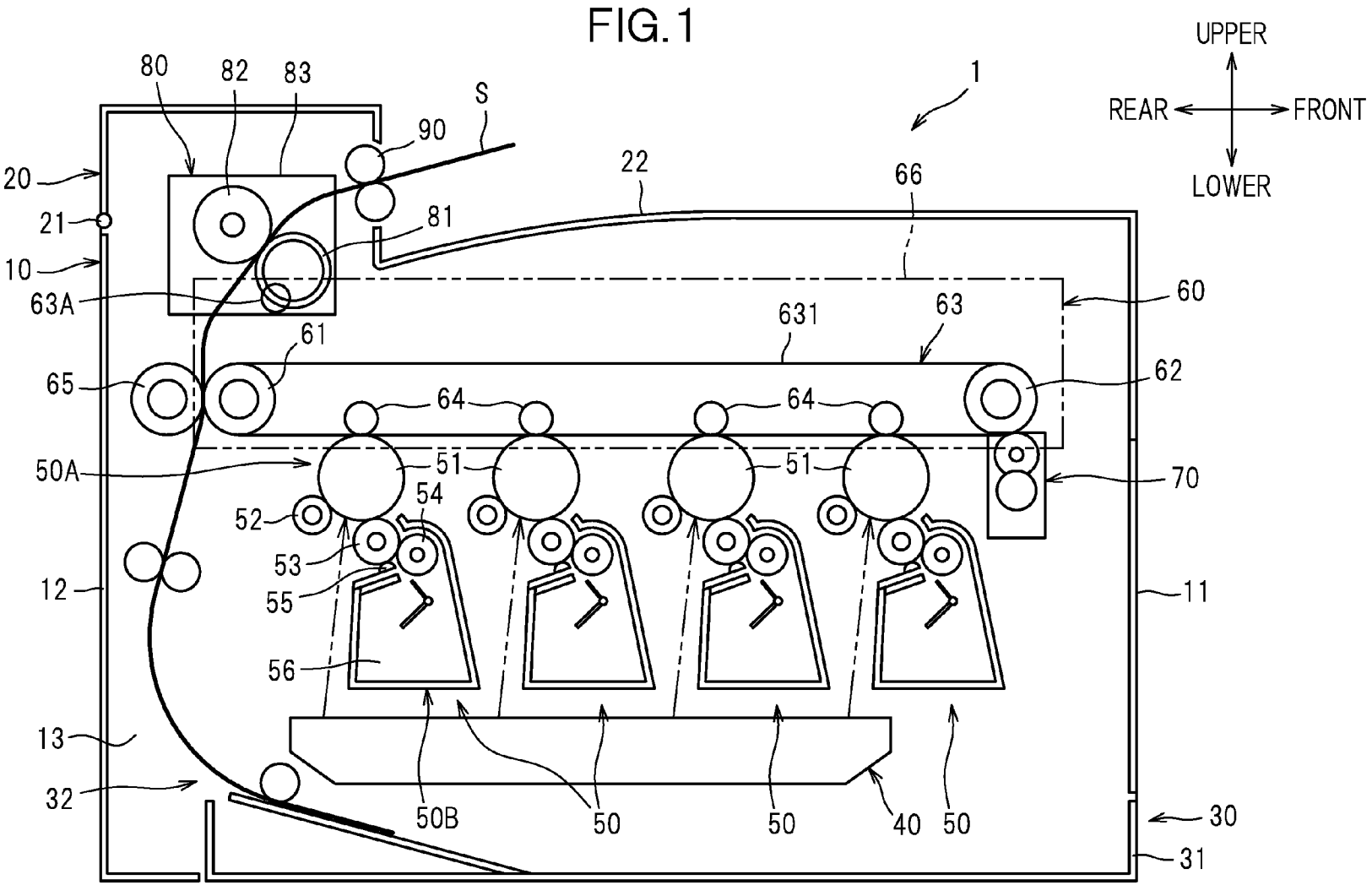
FIG. 1 is a sectional view schematically showing a color printer according to one exemplary embodiment of the present invention.

Detailed description will be given of a color printer as an example of an image forming apparatus according to an illustrative embodiment of the present invention with reference to the drawings. In the following description, the direction is designated as from the viewpoint of a user who is using (operating) the color printer. To be more specific, in FIG. 1, the right-hand side of the drawing sheet corresponds to the "front" side of the color printer, the left-hand side of the drawing sheet corresponds to the "rear" side of the color printer, the front side of the drawing sheet corresponds to the "left" side of the color printer, and the back side of the drawing sheet corresponds to the "right" side of the color printer. Similarly, the direction extending from top to bottom of the drawing sheet corresponds to the "vertical" or "upper-lower" direction of the color printer.

As seen in FIG. 1, the color printer 1 includes a main body casing 10, a top cover 20, a sheet feed unit 30, a scanner unit 40, four process units 50, a transfer unit 60, a cleaning unit 70, and a fixing device 80.

Figure 2:
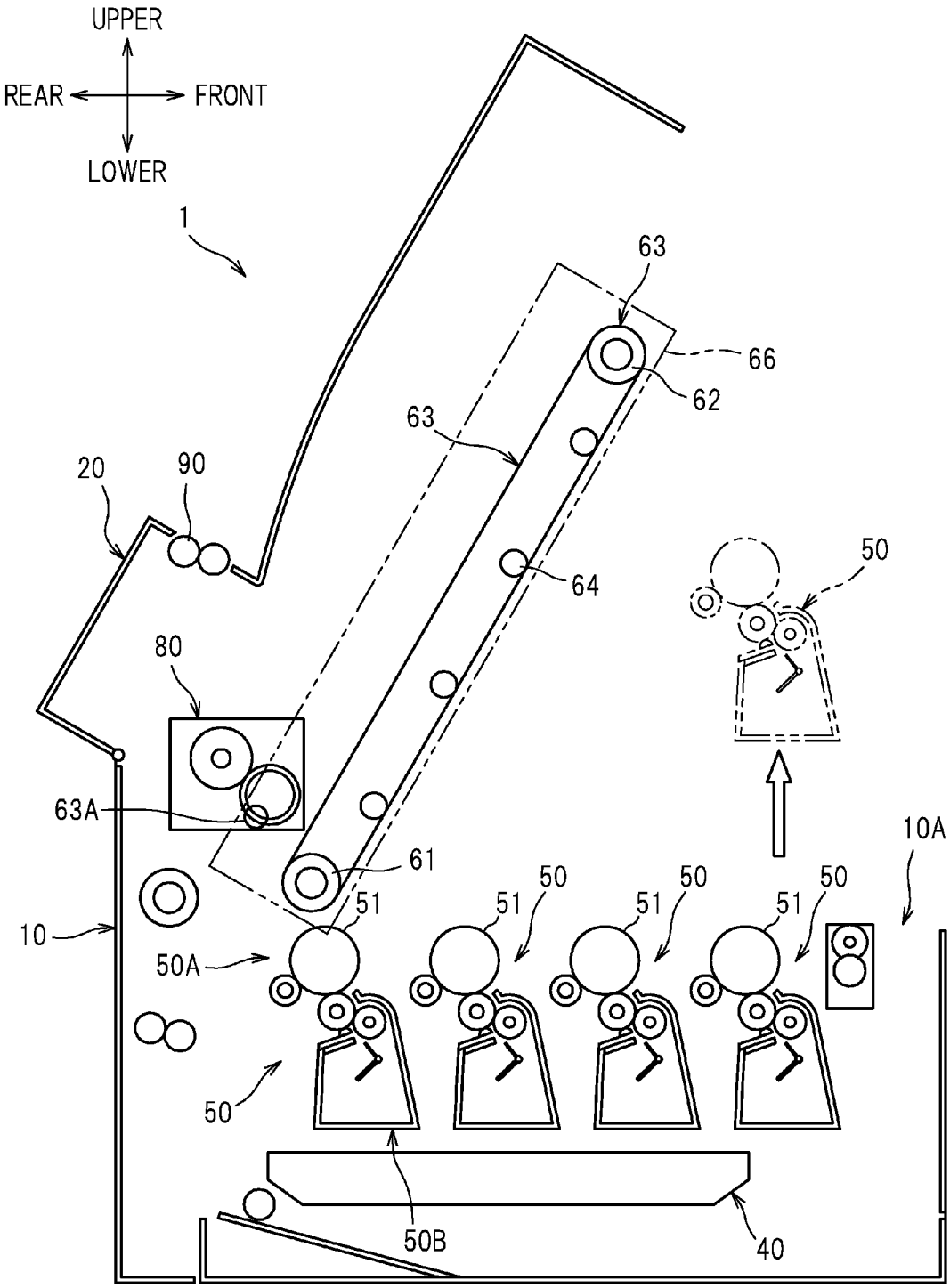
FIG. 2 is a sectional view of the color printer with the top cover being opened.

The main body casing 10 mainly includes a front wall 11 as an example of a first side wall, a rear wall 12 as an example of a second side wall disposed opposite to the first wall in the front-rear direction, right and left side walls 13 connecting the right ends and the left ends, respectively, of the front wall 11 and the rear wall 12. As seen in FIG. 2, an opening 10A is formed in an upper portion of the main body casing 10, and process units 50 (which will be describe later) can be detachably installed through the opening 10A.

The top cover 20 is a cover for openably closing the opening 10A of the main body casing 10. The top cover 20 is rotatably supported by the main body casing 10 so as to be swingable about an axis of rotation 21 provided at an upper rear side of the main body casing 10. A sheet output tray 22 is formed on an upper surface of the top cover 20 so that a sheet of paper (hereinafter simply referred to as "sheet" S) ejected outside the main body casing 10 is received on the sheet output tray 22.

The sheet feed unit 30 is disposed in a lower portion of the main body casing 10. The sheet feed unit 30 includes a sheet feed tray 31 for storing a stack of sheets S, which is an example of a sheet load tray, and a sheet feed mechanism 32 for feeding a sheet S from the sheet feed tray 31 to a transfer position (i.e., a nip portion between an endless belt 63 and a secondary transfer roller 65). Sheets S stored in the sheet feed tray 31 are separated one from the other and then conveyed to the transfer position by the sheet feed mechanism 32.

The scanner unit 40 is disposed above the sheet feed unit 30. The scanner unit 40 includes laser beam emitters, a polygon mirror, lenses and reflecting mirrors, etc., which are not shown in the drawings. In this scanner unit 40, a laser beam emitted from each of the laser beam emitter travels along a path indicated by chain double-dashed line of FIG. 1, so that the surface of the corresponding photoconductor drum 51 is rapidly scanned and illuminated with the laser beam.

It is noted that a device for illuminating the photoconductor drum is not limited to the scanner unit 40 as described above, and other known configuration such as an LED unit may be employed.

Four process units 50 are arranged tandem in the front-rear direction at positions above the scanner unit 40. The process units 50 are detachably supported by the main body casing 10. Each process unit 50 includes a photoconductor unit 50A and a development unit 50B detachably attached to the photoconductor unit 50A.

The photoconductor unit 50A includes a photoconductor drum 51, a charging roller 52, and a casing (not shown) for supporting the photoconductor drum 51 and the charging roller 52. The photoconductor unit 50A is disposed under the endless belt 63 such that the photoconductor drum 51 faces the lower surface of the endless belt 63 as described later.

The development unit 50B is disposed under the photoconductor drum 51 and configured to supply developer to the photoconductor drum 51. To be more specific, the development unit 50B includes a developing roller 53, a supply roller 54, a doctor blade 55, and a toner storage chamber 56.

In this process unit 50, the surface of the photoconductor drum 51 is uniformly charged by the charging roller 52 and then exposed to light by the scanner unit 40, so that an electrostatic latent image based on image data is formed on the surface of the photoconductor drum 51. Toner in the toner storage chamber 56 is supplied to the surface of the developing roller 53 via the supply roller 54.

The thickness of the toner carried on the surface of the developing roller 53 is regulated by the doctor blade 55, and thereafter the toner is supplied to the photoconductor drum 51. Accordingly, the electrostatic latent image is visualized and a toner image is formed on the surface of the photoconductor drum 51.

The transfer unit 60 is disposed under the top cover 20 at a position over the process units 50. The transfer unit 60 mainly includes a drive roller 61, a driven roller 62, an endless belt 63, primary transfer rollers 64 as an example of a primary transfer member, and a secondary transfer roller 65 as an example of a secondary transfer member. The endless belt 63 is looped around the drive roller 61 and the driven roller 62 so as to extend substantially horizontal (in FIG. 1, the upper surface 631 of the endless belt 63 is substantially horizontal). Detailed structure of the endless belt 63 will be described later.

Each of the primary transfer rollers 64 is configured to cause a toner image formed on the photoconductor drum 51 to be transferred onto the endless belt 63. In the transfer unit 60, four primary transfer rollers 64 are provided corresponding to the four photoconductor drums 51 such that they are arranged opposite to the corresponding photoconductor drums 51 across the endless belt 63.

The secondary transfer roller 65 is configured to cause the toner image (complete toner image) having been transferred onto the endless belt 63 to be transferred onto a sheet S conveyed from the sheet feed tray 31. The secondary transfer roller 65 is disposed opposite to the drive roller 61 across the endless belt 63.

In this transfer unit 60, transfer biases are applied to the primary transfer rollers 64 and the secondary transfer roller 65 while the endless belt 63 is being rotated, so that toner images formed on the photoconductor drums 51 corresponding to the respective colors are sequentially transferred onto the endless belt 63 and superposed one on top of the other to form a complete toner image. Thereafter, the complete toner image carried on the endless belt 63 is transferred onto a sheet S, while the sheet S conveyed from the sheet feed unit 30 passes through a transfer position (i.e., nip portion) between the endless belt 63 and the secondary transfer roller 65.

The cleaning unit 70 is a mechanism for collecting toner remaining on the endless belt 63. The cleaning unit 70 is disposed under the front end portion of the endless belt 63. The cleaning unit 70 collects the toner not transferred onto the sheet S at the transfer position and remaining on the endless belt 63.

The fixing device 80 is disposed above the rear end portion of the endless belt 63. The fixing device 80 includes a heating roller 81, a pressure roller 82 configured to be pressed against the heating roller 81, and a fixing device casing 83 for supporting the heating roller 81 and the pressure roller 82. In the fixing device 80, the complete toner image having been transferred onto the sheet S is thermally fixed while the sheet S passes through between the heating roller 81 and the pressure roller 82.

An ejection roller 90 is provided at a position obliquely upward and frontward of the fixing device 80. The ejection roller 90 is configured to forward a sheet S in a frontward direction (outside the main body casing 10). The sheet S conveyed in the frontward direction from the ejection roller 90 is ejected onto the sheet output tray 22 formed on the top cover 20. The ejection roller 90 is rotatably supported by the top cover 20.

Detailed Structure of Endless Belt

The endless belt 63 is configured to be swingable relative to the main body casing 10, independently from the photoconductor drums 51 supported by the main body casing 10. More specifically, the endless belt 63 is configured to be swingable about the axis of rotation 63A provided at the rear side of the main body casing 10 such that the front end portion of the endless belt 63 is swingable in the upper-lower direction. In the drawings, the axis of rotation 63A is emphasized as a circle having a relatively large diameter for the purpose of easy understanding. However, the axis of rotation 63A actually is the center of this circle.

To be more specific, the drive roller 61 and the driven roller 62 for supporting the endless belt 63, and the primary transfer rollers 64 are rotatably supported by a belt casing 66, and the belt casing 66 is supported by the main body casing 10 so as to be swingable around the axis of rotation 63A. Accordingly, these parts are swingable together relative to the main body casing 10. Since the axis of rotation 63A of the endless belt 63 is located at the rear side (near the fixing device 80), the fixing device 80 will not be an obstacle when the user lifts the front end portion of the endless belt 63 upward for replacement of a cartridge. This can ease the replacement of the process unit 50.

This swingable configuration of the endless belt 63 can be obtained, for example, by the combination of a pair of aligned holes formed in the opposite side walls of belt casing 66 and a pair of projections formed on the main body casing 10 and inserted into the holes to thereby allow the belt casing 66 to be rotatable relative to the main body casing 10. As an alternative, a pair of aligned projections formed on the opposite side walls of the belt casing 66 may be inserted into a pair of corresponding holes formed in the main body casing 10 to thereby allow the belt casing 66 to be rotatable relative to the main body casing 10. Further, the belt casing 66 is configured to be swingable without interfering with the fixing device 80, the photoconductor drums 51, and the cleaning unit 70. To be more specific, each of the fixing device 80, the photoconductor drums 51, and the cleaning unit 70 is disposed within the width of the belt casing 66 in the right-left direction.

In particular according to this embodiment, as seen in FIG. 2, the endless belt 63 is configured to be swingable in synchronization with the top cover 20.

More specifically, a part of the front end portion of the belt casing 66 is engaged with the top cover 20, so that when the user lifts the front end portion of the top cover 20 upward, the front end portion of the belt casing 66 engaged with the top cover 20 can also be lifted together.

The part of the front end portion of the belt casing 66 is supported by the top cover 20 and thus when the user closes the top cover 20, the belt casing 66 together with the top cover 20 is swung down into the position shown in FIG. 1. Accordingly, the belt casing 26 is swung up and down simply by opening and closing the top cover 20. This can further ease the replacement of the process unit 50, as compared with the configuration in which the top cover and the endless belt are swung up and down independently.

Next, the position of the axis of rotation 63A will be described in detail.

Figure 3:
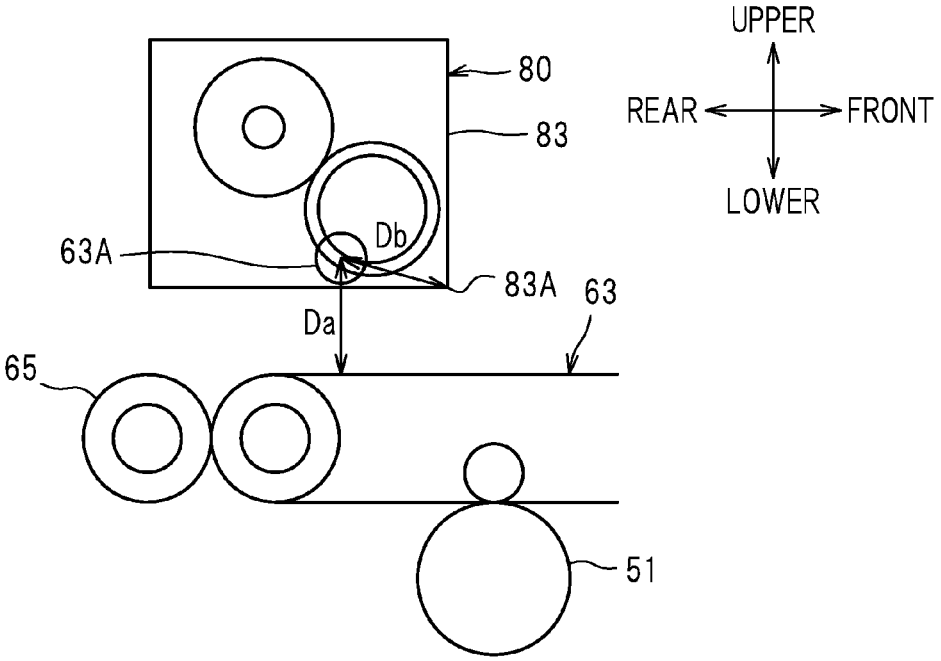
FIG. 3 is a view showing the positional relation among the endless belt, the axis of rotation of the endless belt, and the fixing device casing.

As seen in FIG. 3, the axis of rotation 63A is located at a position above the endless belt 63 and opposite to the endless belt 63 in the upper-lower direction. Further, the position of the axis of rotation 63A and the size and the position of the fixing device casing 83 are determined such that the shortest distance Da from the axis of rotation 63A to the endless belt 63 is greater than the distance Db from the axis of rotation 63A to the front lower corner 83A of the fixing device casing 83 (i.e., the most distant portion that is located on a front lower portion of the fixing device 80 and is the farthest from the axis of rotation 63A).

Setting the shortest distance Da to be greater than the distance Db makes it possible to allow the rotation (swing motion) of the endless belt 63 without interference of the endless belt 63 to the fixing device casing 83 (see FIG. 2).

Figure 4:
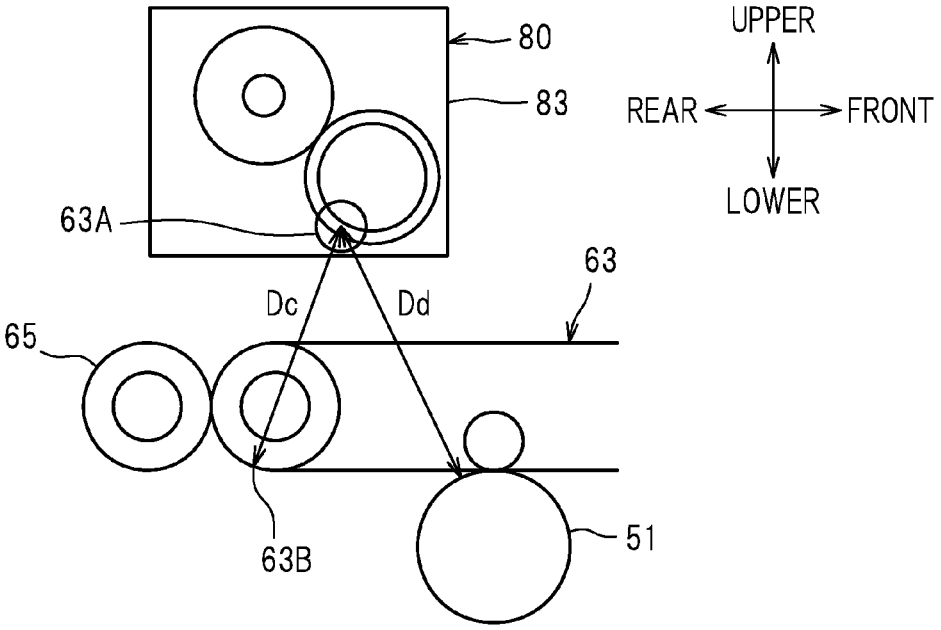
FIG. 4 is a view showing the positional relation among the endless belt, the axis of rotation of the endless belt, and the photoconductor drum.

Furthermore, as seen in FIG. 4, the position of the axis of rotation 63A is determined such that the distance Dc from the axis of rotation 63A to the most distant portion 63B of the endless belt 63 that is located on the rear side of the endless belt 63 between the axis of rotation 63A and the rear wall 12 and is the farthest from the axis of rotation 63A is smaller than the shortest distance Dd from the axis of rotation 63A to the photoconductor drum 51.

Accordingly, since the distance Dc is set to be smaller than the shortest distance Dd, as seen in FIG. 2, the endless belt 63 does not interfere with the photoconductor drum 51 when it is rotated (swung open).

According to the color printer 1 as described in this embodiment, in addition to the above-described advantageous effects, the following advantageous effects can be achieved.

Since the ejection roller 90 is located at the rear side, which is the same side as the fixing device 80, the ejection roller 90 is less likely to be an obstacle while the user opens the top cover 20 for replacement of a process cartridge 50. Further, since the ejection roller 90 located at the rear side of the color printer 1 ejects a sheet S outside the main body casing 10 toward the front side of the color printer 1, the user can remove the printed sheet S that have been ejected onto the sheet output tray 22 of the top cover 20 from the front side, that is, from the same side as the user manipulates the top cover 20.

Although an illustrative embodiment of the present invention has been described in detail, the present invention is not limited to this specific embodiment. It is to be understood that various changes and modifications, such as those described below, may be made to any of the specific configurations without departing from the scope of the appended claims. In the following description, parts similar to those previously described in the above embodiment are denoted by the same reference numerals and detailed description thereof will be omitted.

Figure 5A:
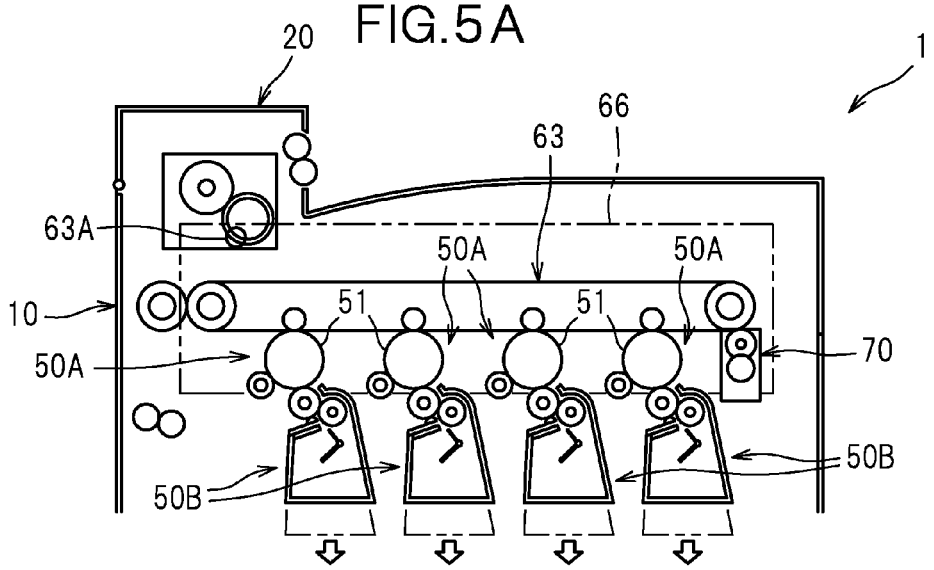
FIGS. 5A and 5B show the color printer according to a modified embodiment, in which the photoconductor drums and the endless belt are swung together.
Figure 5B:
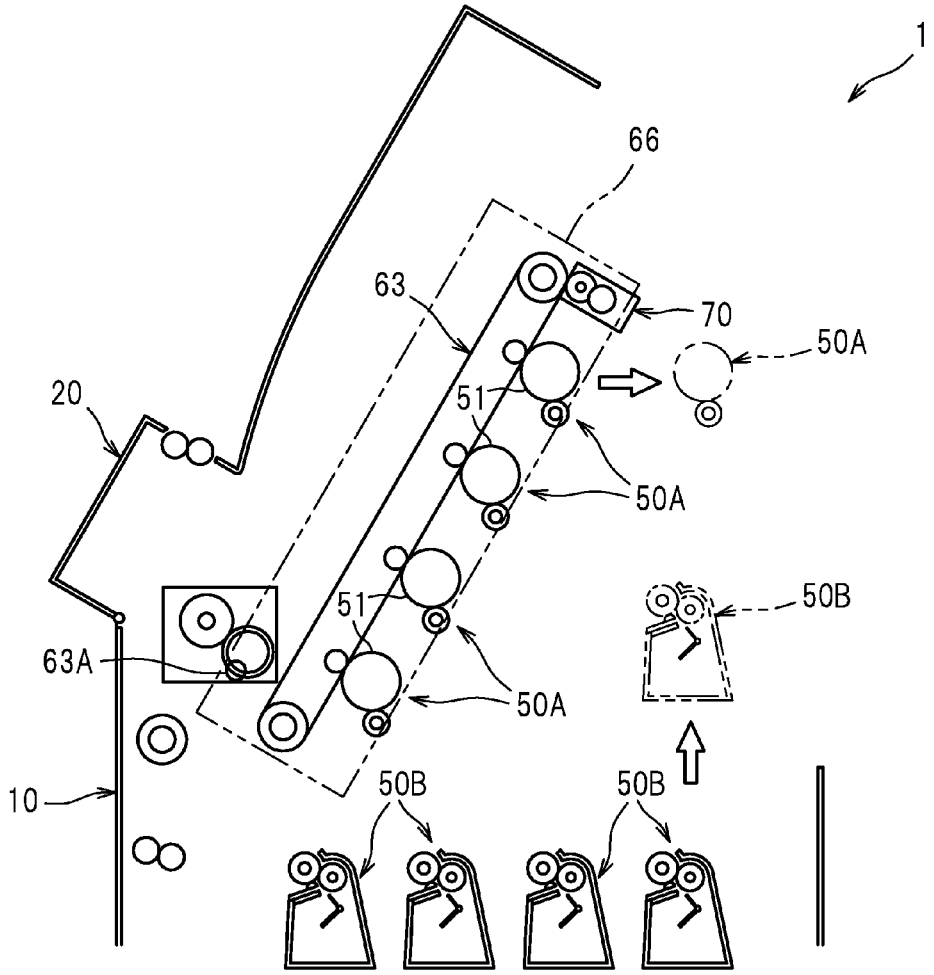

In the above exemplary embodiment, the endless belt 63 is configured to be swingable independently from the photoconductor drums 51 that are supported by the main body casing 10. However, the present invention is not limited to this specific configuration. For example, as seen in FIGS. 5A and 5B, the photoconductor drums 51 may be configured to be swingable together with the endless belt 63. To be more specific, photoconductor units 50A each containing a photoconductor drum 51 may be detachably attached to the belt casing 66.

With this configuration, when the user swings open the top cover 20 so as to lift the endless belt 63 together with the top cover 20, the photoconductor units 50A are oriented to face frontward. This can further ease the replacement of the photoconductor units 50A.

This can also ease the replacement of the development units 50B. It is possible that the four photoconductor units 50A are integrally formed and the photoconductor units 50A for four different colors are replaced together at one time. It is further possible that the endless belt 63 and the four photoconductor units 50A are configured to be replaceable together in a single operation.

In this modified embodiment shown in FIGS. 5A and 5B, the cleaning unit 70 is configured to be detachably attached to the belt casing 66. Accordingly, when the user swings open the top cover 20 so as to lift the endless belt 63 together with the top cover 20, the cleaning unit 70 is oriented to face frontward. This can further ease the replacement of the cleaning unit 70.

Further, according to the color printer 1 described in FIGS. 5A and 5B, the development units 50B are configured to be movable between a contacting position (shown by solid lines) as an example of a first position, in which the development units 50B contact the photoconductor drums 51 and a retreated position (whose lower end portion is shown by chain double-dashed lines) as an example of a second position, in which the development units 50B are away from the photoconductor drums 51, and the development units 50B are configured to be positioned in the retreated position when the photoconductor units 50A and the endless belt 63 are swung (rotated) together. To be more specific, for example, an actuator for causing the development units 50B to be moved between the contacting position and the retreated position is provided and the actuator may be controlled by a controller such that the development units 50B are moved into the retreated position each time a printing operation ends.

With this configuration, interference of the swung photoconductor units 50A with the development units 50B can be reliably prevented.

Figure 6:
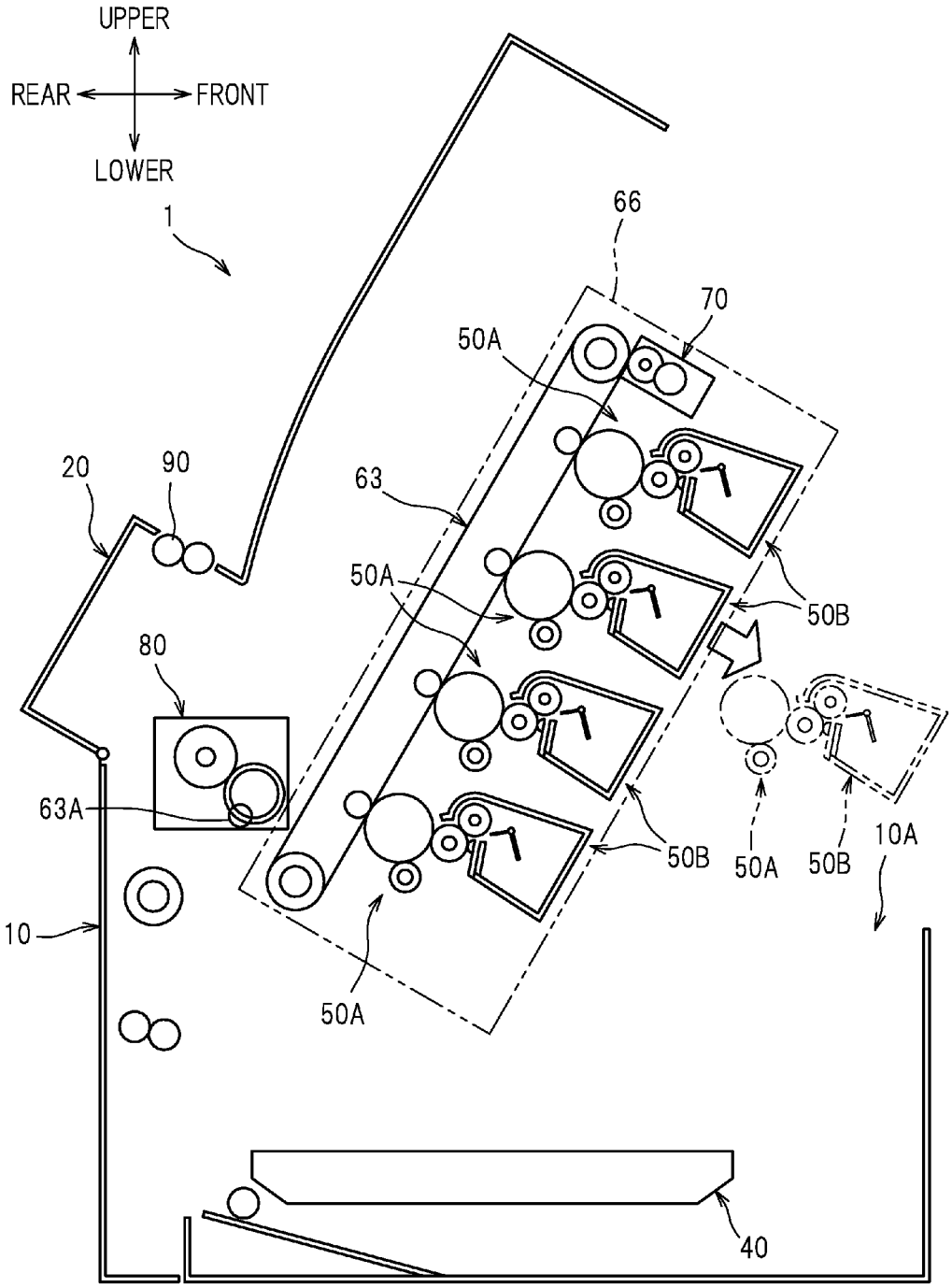
FIG. 6 is a sectional view showing the color printer according another modified embodiment, in which the endless belt, the photoconductor units, and the development units are swung together.

Further, as seen in FIG. 6, the development units 50B may be configured to be swingable (rotatable) together with the photoconductor units 50A and the endless belt 63. To be more specific, the development units 50B may be detachably attached to the belt casing 66.

With this configuration, when the user swings open the top cover 20 so as to lift the endless belt 63 together with the top cover 20, the photoconductor units 50A and the development units 50B are oriented to face frontward. This can further ease the replacement of the photoconductor units 50A and the development units 50B.

In the above exemplary embodiment, the top cover 20 and the endless belt 63 are configured to be swingable in synchronization with each other. However, the present invention is not limited to this specific configuration. For example, the top cover and the endless belt may be configured to be independently swingable in a non-synchronous manner.

Further, in the above exemplary embodiment, a sheet S such as a cardboard, a postcard, and a thin paper, etc. is used as an example of a sheet. However, the present invention is not limited to this specific embodiment. For example, an OHP sheet may be used as a sheet.

In the above exemplary embodiment, the transfer rollers 64, 65 are used as examples of transfer members. However, the present invention is not limited to this specific embodiment. For example, other members to which a transfer bias is applicable, such as a conductive brush and a conductive leaf spring, may be used in place of these transfer rollers 64, 65.

In the above exemplary embodiment, the present invention is adapted to the color printer 1. However, the present invention is not limited to this specific embodiment, and may be applicable to other image forming apparatuses such as a copying machine and a multifunction peripheral. In particular, it is more effective if the present invention is adapted to a multifunction peripheral 100 such as shown in FIG. 7.

Figure 7:
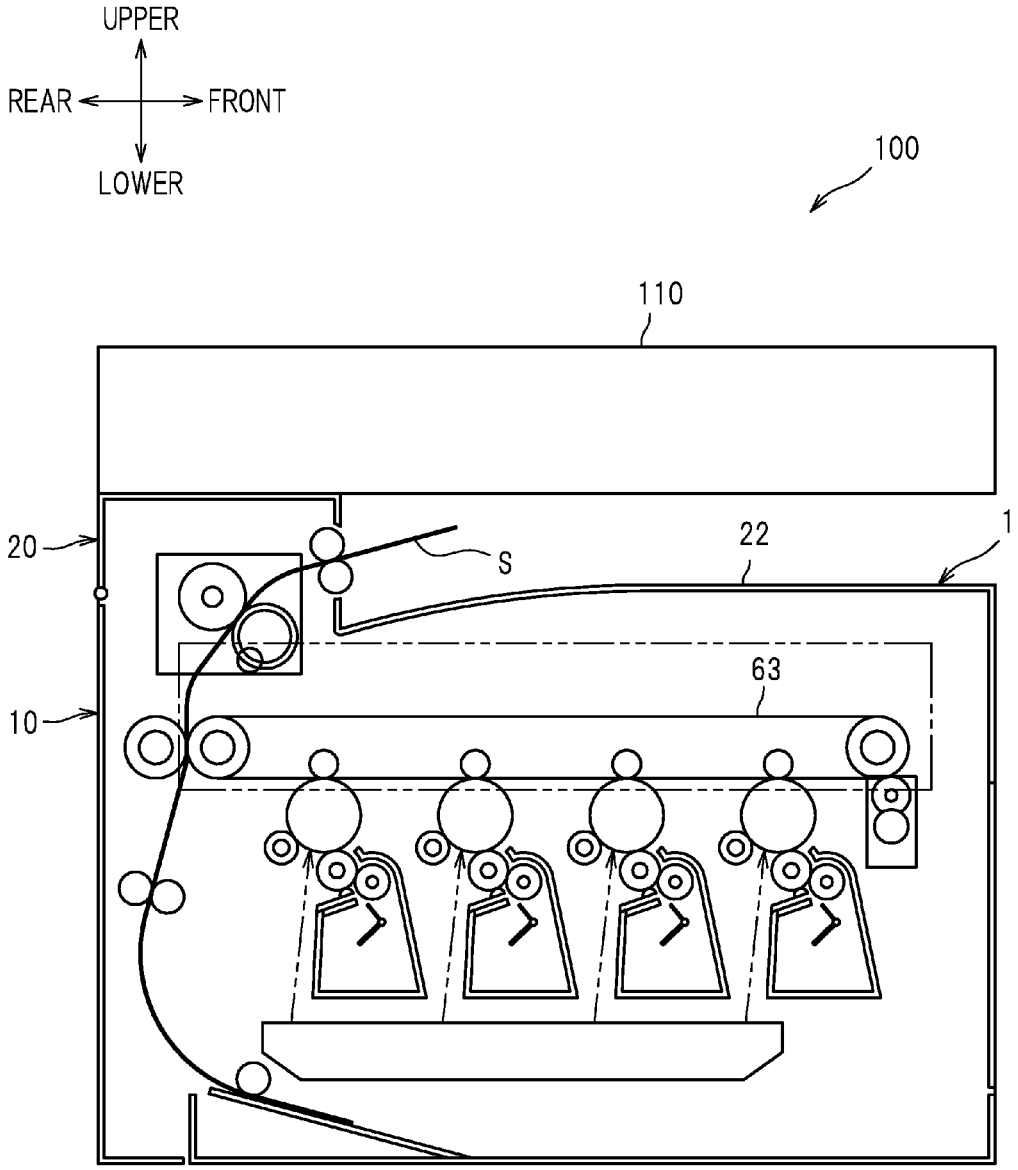
FIG. 7 is a sectional view showing a multifunction peripheral which embodies the present invention.

To be more specific, the multifunction peripheral 100 shown in FIG. 7 includes a document reader 110. The document reader 110 is disposed above the sheet output tray 22 at a position opposite to the sheet output tray 22 in the upper-lower direction; more specifically, the document reader 110 extends frontward from an upwardly protruding portion of the color printer 1 which protrudes upward beyond the sheet output tray 22. In this multifunction peripheral 100, the document reader 110 is swingable together with the top cover 20.

According to this configuration of the multifunction peripheral 100, since the printed sheets S that have been ejected onto the sheet output tray 22 are unable to be removed from the rear side, it is advantageous that the user removes the sheets S having been ejected onto the sheet output tray 22 from the same side as the user manipulates the front cover 20 (endless belt 63). This is more prominent if side walls for closing a space between the sheet output tray 22 and the document reader 110 are provided at both right and left sides of the sheet output tray 22.

What is claimed is:

1. An image forming apparatus comprising:

a main body casing having a first side wall and a second side wall which are opposite to each other, and an upper portion in which an opening is formed;

a top cover swingably supported on the upper portion of the main body casing at a position near the second side wall and configured to openably close the opening;

an endless belt disposed below the top cover and having a first end portion closer to the first side wall and a second end portion closer to the second side wall;

a photoconductor drum disposed under the endless belt;

a development unit disposed under the photoconductor drum and configured to supply developer to the photoconductor drum; and a fixing device disposed above the second end portion of the endless belt, wherein the endless belt is configured to be swingable about an axis of rotation provided near the second side wall such that the first end portion of the endless belt is swingable in an upper-lower direction, and wherein the axis of rotation is located at a position above the endless belt, and wherein a shortest distance Da from the axis of rotation to the endless belt is set to be greater than a distance Db from the axis of rotation to a most distant portion of the fixing device that is located on a lower portion of the fixing device closer to the first side wall than the axis of rotation, and that is farthest from the axis of rotation.

2. The image forming apparatus according to claim 1, wherein the endless belt is configured to be swingable in conjunction with the top cover.

3. The image forming apparatus according to claim 1, wherein the endless belt is configured to be swingable independently from the photoconductor drum supported by the main body casing, wherein the axis of rotation is located at a position above the endless belt and opposite to the endless belt in the upper-lower direction, and wherein a distance Dc from the axis of rotation to a most distant portion of the endless belt that is located between the axis of rotation and the second side wall and is farthest from the axis of rotation is smaller than a shortest distance Dd from the axis of rotation to the photoconductor drum.

4. The image forming apparatus according to claim 1, wherein the photoconductor drum is configured to be swingable together with the endless belt.

5. The image forming apparatus according to claim 1, further comprising:

a sheet load tray located in a lower portion of the main body casing and configured to store a stack of sheets;

a primary transfer member configured to cause a developer image carried on the photoconductor drum to be transferred onto the endless belt;

a secondary transfer member configured to cause the developer image transferred on the endless belt to be transferred onto a sheet conveyed from the sheet load tray; and an ejection roller disposed above the fixing device and configured to forward the sheet toward the first side wall, so as to eject the sheet outside the main body casing onto the top cover.

6. An image forming apparatus comprising:

a main body casing having a first side wall and a second side wall which are opposite to each other, and an upper portion in which an opening is formed;

a top cover swingably supported on the upper portion of the main body casing at a position near the second side wall and configured to openably close the opening;

an endless belt disposed below the top cover and having a first end portion closer to the first side wall and a second end portion closer to the second side wall;

a photoconductor drum disposed under the endless belt;

a development unit disposed under the photoconductor drum and configured to supply developer to the photoconductor drum; and a fixing device disposed above the second end portion of the endless belt, wherein the endless belt is configured to be swingable about an axis of rotation provided near the second side wall such that the first end portion of the endless belt is swingable in an upper-lower direction, wherein the photoconductor drum is configured to be swingable together with the endless belt, and wherein the development unit is configured to be movable between a first position in which developer is supplied from the development unit to the photoconductor drum and a second position which is away from the first position and in which the development unit is retreated from the photoconductor drum, and wherein the development unit is configured to be positioned in the second position when the photoconductor drum and the endless belt are swung together.

7. An image forming apparatus comprising:

a main body casing having a first side wall and a second side wall which are opposite to each other, and an upper portion in which an opening is formed;

a top cover swingably supported on the upper portion of the main body casing at a position near the second side wall and configured to openably close the opening;

an endless belt disposed below the top cover and having a first end portion closer to the first side wall and a second end portion closer to the second side wall;

a photoconductor drum disposed under the endless belt;

a development unit disposed under the photoconductor drum and configured to supply developer to the photoconductor drum; and a fixing device disposed above the second end portion of the endless belt, wherein the endless belt is configured to be swingable about an axis of rotation provided near the second side wall such that the first end portion of the endless belt is swingable in an upper-lower direction, wherein the photoconductor drum is configured to be swingable together with the endless belt, and wherein the development unit is configured to be swingable together with the photoconductor drum and the endless belt.

* * * * *